US008470159B2

(12) United States Patent
Tsai et al.

(10) Patent No.: US 8,470,159 B2
(45) Date of Patent: Jun. 25, 2013

(54) SURFACE TREATMENT METHOD AND DEVICE THEREOF

(75) Inventors: Yao Yang Tsai, Taipei (TW); Chien Hoa Tzeng, Taipei (TW)

(73) Assignee: National Taiwan University, Taipei (TW)

( * ) Notice: Subject to any disclaimer, the term of this patent is extended or adjusted under 35 U.S.C. 154(b) by 1279 days.

(21) Appl. No.: 11/900,106

(22) Filed: Sep. 10, 2007

(65) Prior Publication Data

US 2008/0000584 A1 Jan. 3, 2008

(30) Foreign Application Priority Data

Mar. 2, 2007 (TW) ..... 96107298 A

(51) Int. Cl.
*B23H 7/14* (2006.01)
*B23H 7/34* (2006.01)

(52) U.S. Cl.
USPC ..... 205/647; 204/229.2

(58) Field of Classification Search
USPC ..... 204/229.2; 205/647
See application file for complete search history.

(56) References Cited

U.S. PATENT DOCUMENTS 6,297,159 B1 * 10/2001 Paton ..... 438/693

FOREIGN PATENT DOCUMENTS

DE 19902422 A1 * 8/2000
KR 2005114086 A * 12/2005

* cited by examiner

*Primary Examiner* — Nicholas A Smith
(74) *Attorney, Agent, or Firm* — Gottlieb, Rackman & Reisman, P.C.

(57) ABSTRACT

A surface treatment method is provided. A surface treatment method comprising steps of providing a first and a second conductors; applying an electrical field between the first and the second conductors; enclosing the first and the second conductors with a material whose viscosity is varied with an intensity of the electrical field; actuating the first and the second conductors such that the first and the second conductors are in a relative motion with respect to each other; and varying the intensity of the electrical field.

15 Claims, 2 Drawing Sheets

(a)

(b)

SURFACE TREATMENT METHOD AND DEVICE THEREOF

FIELD OF THE INVENTION

The present invention relates to a surface treatment method, in particular, to a surface treatment method combining both EDM process and polishing process.

BACKGROUND OF THE INVENTION

With the prosperous development of 3C industry for the sake of pursuing the fashionable trend of the market, the current appearance of the 3C apparatus must be designed as tiny as possible and the surface thereof should be polished as mirror-like as possible, so that the requirement of the mold for producing those good-looking case of those 3C products must also meet the preceding requirement as well. In the same time, it also has to further satisfy the demands for maintaining high productivity, extending the duration of mold, and cost down. The most frequently used machining scheme for machining the mold surface is the micro electrical discharging machining (micro-EDM) that is used to be classified as a contact-less type machining. Since while the discharging process is being performed the electrodes used in the process does not contact with the work-piece, so that the surface of work-piece would thus not be influenced by the cutting action or the residual stress over the surface as the conventional contact type machining. Therefore, the application of micro-EDM scheme would not be restricted by the mechanical characters of material, such that it could be applied to machine the extremely hard material and to machine the hardly-cut material. Essentially, the micro-EDM scheme provides the outstanding machining characters and would not be limited by the surface shape of material. In this respect, the scheme is able to machine the object with very thin, slight and tiny volume, complex surface or curve shape. However, numerous micro-craters, cracks and recasted layers induced during the discharging process in the EDM scheme might spread all over the surface of machined object, and the machining quality of surface is therefore influenced, which causes the surface roughness of machine object fails to achieve the anticipative criterion. So majority of numbers of research aim to improve the micro-EDM scheme, which are focused on decreasing the discharging energy, diminishing the electrical current pulse, reducing the duration period of discharging, adding the extra auxiliary powders, or trying the newly electrode material, so as to resolve the issue above the poor surface roughness after performing the micro-EDM scheme. However, even though one could adaptively change and optimize the machining parameters or other conditions in the process, for a single process, it always has its own inherent limitation, which is inevitably unable to break through the inherent limitations. Thus, for a conventional EDM scheme, the machined surface of object should be subsequently polished as a post-process, so as to reach the precise and fine requirements for mold in 3C industry. There are many kinds of polishing process, such as the ionized grit polish, the immobilized grit polish and the grit-less polish. However, no matter which kind of polish is quite complicated and trivial, and is usually time-demanding and costs expansive. Besides, since the work-piece has to be further moved to the polishing base after machining process, it will become a tough issue to be overcame regarding how to precisely locate and position the work-piece on the polishing base in order to maintain the requirements as aforementioned.

A better way to thoroughly eliminate the preceding inherent limitation is to incorporate several different polishing processes into EDM process, so as to take from the long to add to the short. At present, the known polishing scheme to be incorporated into the micro-EDM scheme includes the Electropolishing scheme, the Electrophoretic deposition scheme, the Magnetic abrasive finishing scheme, and the ultrasonic vibration scheme etc. The advantages and the disadvantages of aforementioned polishing schemes are briefly introduced as follows: (1) the Electropolishing scheme adopts the special electrolyte fluid different from the general EDM fluid and is unable to incorporate into the EDM together, and furthermore, during polishing, since the air bubble passivation layer is involved in, the process thus becomes unstable and the polished shape is prone to be rounded; (2) for the Electrophoretic deposition scheme, the composite strength of deposited layer should be controlled, and the deposited thickness is easily influenced by the shape. The scheme is therefore unable to polish the work-piece having complex shape with large curvature. Further, since the strong acid electrolyte and the assisted electrodes are needed for performing the scheme, the process would become complicated; (3) for the Magnetic abrasive finishing scheme, it applies a flexible magnetic polishing brush, but the magnetic field is hardly controlled and the required equipments are complicated and also hardly controlled; and (4) for the ultrasonic vibration scheme, the abrasive grits are not easily loaded into the abrasive region which causes the efficiency of polishing got worse. Further the relative vibration existing between the polishing equipments and the work-piece would reduce the precision.

To overcome the mentioned drawbacks of the prior art, a surface treatment method and device thereof are provided.

SUMMARY OF THE INVENTION

According to the first aspect of the present invention, a surface treatment method including steps of providing a first and a second conductors; applying an electrical field between the first and the second conductors; enclosing the first and the second conductors with a material whose viscosity is varied with an intensity of the electrical field; actuating the first and the second conductors such that the first and the second conductors are in a relative motion with respect to each other; and varying the intensity of the electrical field is provided.

Preferably, the method further includes a step of applying a voltage difference to the first and the second conductors.

Preferably, the method further includes steps of increasing the voltage difference; and decreasing the voltage difference.

Preferably, a gap exists between the first and the second conductors.

Preferably, one of the first and the second conductors is a work-piece.

Preferably, one type of the relative motion is to rotate one of the first and the second conductors.

Preferably, the material includes an Electrorheological fluid and a plurality of grits.

Preferably, the Electrorheological fluid includes a silicon oil and an starch.

According to the second aspect of the present invention, a surface treatment method including steps of providing a first and a second conductors; enclosing the first and the second conductors with a material whose viscosity is varied with an intensity of the electrical field; and actuating the first and the second conductors such that the first and the second conductors are in a relative motion with respect to each other is provided.

According to the third aspect of the present invention, a surface treatment device including a first and a second conductors enclosed by the material whose viscosity is varied with an intensity of an electrical field; and an actuator causing the first and the second conductors to have a relative motion of the first and the second conductors with respect to each other is provided.

Preferably, a voltage difference is applied to the first and the second conductors so as to form an electrical field therebetween.

Preferably, the intensity of the electrical field is varied with a variation of the voltage difference.

Preferably, a gap exists between the first and the second conductors.

Preferably, one of the first and the second conductors is a work-piece.

Preferably, one of the first and the second conductors is rotated by the actuator so as to form the relative motion.

Preferably, the material includes an Electrorheological fluid and a plurality of grits.

Preferably, the Electrorheological fluid includes a silicon oil and an starch.

The present invention bears a plurality of advantages and features as follows: (1) it is able to improve the polishing accuracy for any sophisticated and tiny mold; (2) it utilizes the electrical field between the electrode and the work-piece to control the structure of ER fluid, so that a rapid response rate (approximate to 1 ms) and a reversibility is available; (3) it is able to be performed with the EDM process together; (4) it provides a flexible polishing brush for polishing surface having the complex shape and the excellent fine roughness for the machined surface could be easily obtained; (5) it is a pioneer method to incorporate the ER fluid into the EDM process all over the world; (6) it combines the present EDM process and the polishing process into one process for polishing mold; (7) the perspective improvement for the ER-involved EDM polish technique would not be limited by the surface shape of material and could be evolved to the advanced micro polish technique which is far beyond any of the current polish technique; (8) the conventional EDM process fails to overcome the dilemma of mirrorization for the surface and the optimum surface roughness merely goes up to Ra 0.2 μm; however, for the present application, under the appropriate concentration for the machining liquid and the adequate discharging condition, the optimum surface roughness could go up to Ra 0.06 μm or go up to the order of nanometer, completely fulfilling the mirror-like surface requirements; and (9) the present method does not only incorporate the EDM process and the polishing process so as to improve the quality for the surface, but also saves polishing times and cost for the post-process.

The foregoing and other features and advantages of the present invention will be more clearly understood through the following descriptions with reference to the drawings:

BRIEF DESCRIPTION OF THE DRAWINGS

FIG. 2(*b*) is a diagram illustrating the state of charging that there is an electrical field applied between the work-piece and the conductors according to the present invention; and

DETAILED DESCRIPTION OF THE PREFERRED EMBODIMENT

The present invention will now be described more specifically with reference to the following embodiments. It is to be noted that the following descriptions of preferred embodiments of this invention are presented herein for the aspect of illustration and description only; it is not intended to be exhaustive or to be limited to the precise from disclosed.

Figure 1:
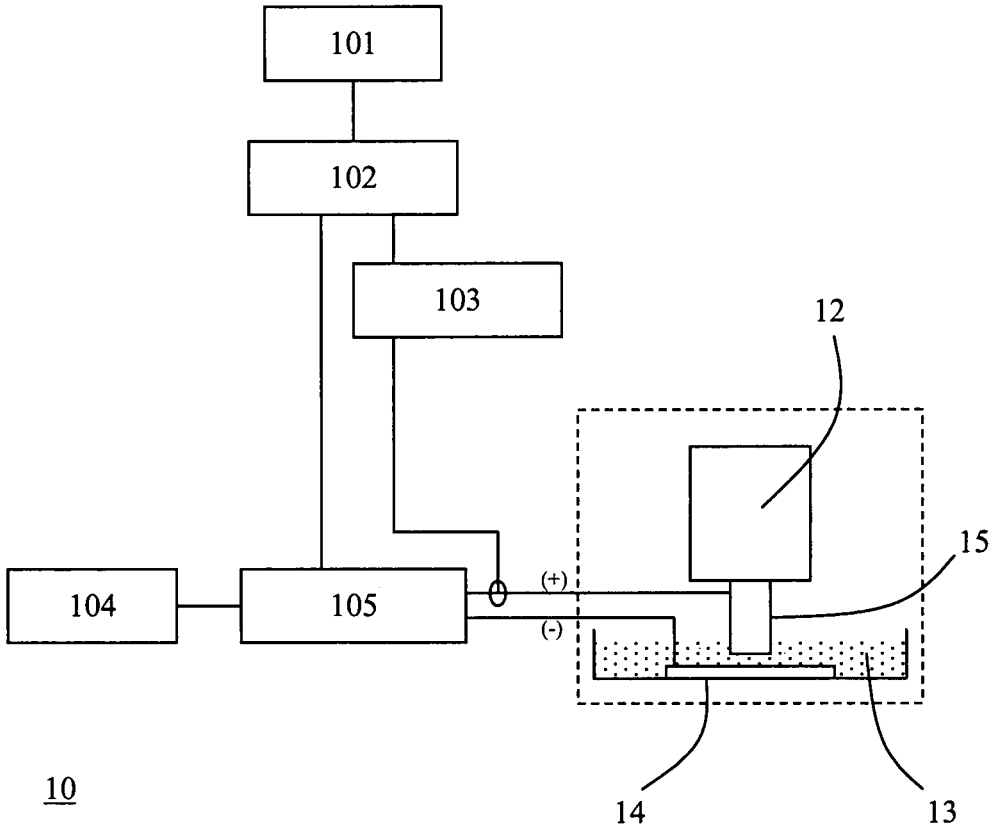
FIG. 1 is a diagram illustrating a fundamental implementation for the present invention.

Please refer to FIG. 1, which is a diagram illustrating a fundamental implementation for the present invention. The fundamental implementation 10 demonstrated in FIG. 1 includes a computer 101, an oscilloscope 102, a galvanometer 103, a power source 104, a control circuit 105, an actuator 12, an Electrorheological (ER) fluid 13, a work-piece 14 and a conductor 15, wherein the actuator 12 is a motor or any other devices able to cause the conductor 15 to have the rotation. Typically, the work-piece 14 and the conductor 15 are immersed in the ER fluid 13, so that the work-piece 14 and the conductor 15 are enclosed by the ER 13. The material of the work-piece 14 is a conductive material. A gap whose size is in a range of 5 μm to 50 μm exists between the work-piece 14 and the conductor 15. The work-piece 14 is any thing whose surface is needed to be machined (the surface treatment) or polished, such as the cases of cell phones, of the digital cameras, of the PDAs (Personal Digital Assistant) or of the MP3 (Media Player 3rd generation) etc.

The ER fluid 13 adopted by the present invention is also termed as Winslow fluid which discovered by Winslow. It is consist of dielectrical particles in the insulating fluid whose dimension is in a range of nanometer to micrometer. These dielectrical particles are prone to be easily polarized for the circumstances that an external electrical field is applied thereto. For instance, under high electrical field strength of several kV/mm, the ER fluid would be transformed into a plastic flow, which is plasticized. If the strength of electrical field becomes stronger, even the ER fluid would become the solid, which is solidified. Once the external electrical field is switched off, the ER fluid recovers to the common liquid status. The ER fluid is the Newtonian fluid without the electrical field applied but it becomes the Bingham plastic flow when applying the electrical field. It indicates the strength of electrical field determines the behavior of ER fluid. In accordance with the preceding descriptions, it is realized that the ER fluid 13 is a kind of the material whose viscosity is varied with an intensity of the electrical field.

The ER fluid 13 proposed in the present invention includes a starch and a silicon oil (TSF4511-50) as the carrying liquid, and a plurality of abrasive grits is added into the ER fluid 13 wherein the plurality of abrasive grits is the oxide aluminum ($Al_2O_3$). The ER fluid of the present invention is not limited to be the liquid, since with the variation of the concentration of the abrasive grits, the ER fluid would be possible to be the suspending liquid, the sticky colloid liquid, or the half-solid liquid.

When processing the EDM polish, the control circuit 105 is first made contact with the power source 104. Then the positive current (+) and the negative current (−) are respectively applied to the conductor 15 and the work-piece 14 (it is not limited to apply the positive current (+) and the negative current (−) to the respective conductor 15 and work-piece 14, vice versa, it is allowed to apply the negative current (−) and the positive current (+) to the respective conductor 15 and work-piece 14 as well), and a voltage difference is formed between the conductor 15 and the work-piece 14, by controlling the control circuit 105 so that an electrical field is then formed therebetween, whereby the electrical field is varied with respect to the voltage difference.

Subsequently, the actuator 12 is turned on so as to actuate the conductor 15 to proceed the symmetrical rotation, whereby the first and the second conductors are actuated such that the first and the second conductors are in a relative motion with respect to each other (it is not limited to actuate the conductors 15 by the actuator 12, and vice versa, it is also able to actuate the work-piece 14 by the adequate scheme whereby the work-piece 14 and the conductors 15 are actuated such that the work-piece 14 and the conductors 15 are in a relative motion with respect to each other). In the period that the work-piece 14 and the conductors 15 are in a relative motion with respect to each other, the magnitude of the voltage difference is controlled by the control circuit 105 in accordance with the demands, and collaterally the magnitude of the electrical field therebetween is varied. In most occasions, the variation of the magnitude of the electrical field is regularly alternated by increasing and decreasing the voltage difference. That is, the voltage difference would be regularly increased and decreased by a specified frequency scheme whereby the regular variation of the intensity of the electrical field is formed (it is not limited to the specified frequency scheme, and vice versa, it is also able to be proceeded with a non-specified frequency scheme in accordance with the demands).

Figure 2:
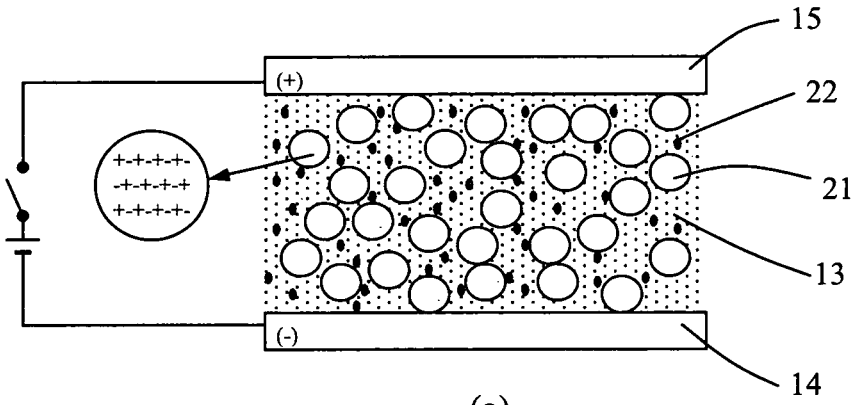
FIG. 2(*a*) is a diagram illustrating the state of discharging that there is no electrical field applied between the work-piece and the conductors according to the present invention.
Figure 2:
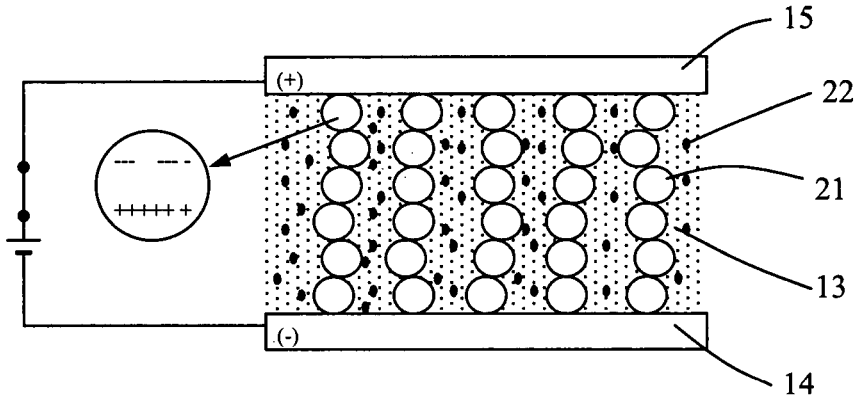

Please keep referring to FIGS. 2(*a*) and (*b*), which are diagrams illustrating the principle how the present invention accomplishes the EDM and and the negative electrical charges and the positive electrical charges are respectively concentrated at two ends of the ER particles 22. Therefore a plurality of the chain fiber structures formed by the polarized ER particles 22 would be regularly spread over the ER fluid 13, as that disclosed state in FIG. 2(*b*). It is the charge polishing state. In this state, since the conductors 15 is still rotating, the plurality of the chain fiber structures (or termed as polishing brush) formed by the polarized ER particles 22 in the ER fluid 13 will drive the abrasive grits 21 adhered thereon to polish the surface, and further produce a very fine polish.

To sum up, the most fundamental implementation for the present invention is to apply a voltage difference between the work-piece 14 and the conductors 15, and then to increase or to decrease the voltage difference in alternative by a regular specified frequency scheme. While in the discharging state (that is to decrease the voltage difference), the defects or the redundant material over the surface of the work-piece 14 are trimmed thereby, and while in the charging state (that is to increase the voltage difference), the surface of the work-piece 14 is polished by charging, whereby the "EDM" process and the "surface polishing" process are integrated into one process in the present invention. However, it is noted that the implementation of the present invention is not limited to vary the voltage difference or the electrical field in a specified frequency scheme, and it is also feasible to vary the voltage difference or the magnitude of the electrical field in a non-specified frequency scheme in accordance with the demands.

With respect to the effect of the present invention, the results are reported in the following text. The permittivities are set as 0.068 μF and 0.01 μF respectively, the maximum voltage is set to 250V and the rotational speed of the the polishing in the meantime. In FIG. 2, it includes work-piece 14, conductors 15, abrasive grits 21 and ER particles 22 spreading in the ER fluid 130. Wherein, since the ER fluid in the present invention composes of the silicon oil and starch the ER particles 22 is therefore the starch particle, and the abrasive grits 21 is the alumina powders ($Al_2O_3$). Please refer to FIG. 2(*a*), which is a diagram illustrating the state of discharging that there is no electrical field applied between the work-piece and the conductors according to the present invention. The discharging state includes the state that the voltage difference between the work-piece 14 and the conductors 15 is decreasing (the discharging state of decreasing the voltage difference), or there is none of the voltage difference between the work-piece 14 and the conductors 15 (there is no electrical current between the work-piece 14 and the conductors 15). At this moment, since all the electrical charges existing in the ER particles 22 randomly and irregularly spread over the surface of the ER particles 22, the ER particles 22 is thus not in a particularly polarized state, but being in a charge neutral state. It is the electrical discharge machining (EDM) state. In the EDM state, the sparks caused by the instantaneous voltage drop at the discharging moment is able to remove the redundant material over the surface of the work-piece 14, so as to trim/machine the surface of the work-piece 14.

Please keep referring to FIG. 2(*b*), which is a diagram illustrating the state of charging that there is an electrical field applied between the work-piece and the conductors according to the present invention. The charging state includes the state that the voltage difference between the work-piece 14 and the conductors 15 is increasing (the charging state of increasing the voltage difference). At this moment, since all the electrical charges existing in the ER particles 22 demonstrate the particular polarized state, actuator is set to 2000 rpm. The results show when the concentration of the ER fluid is 0-10 wt % (weighted percentage concentration) and the permittivity is set as 0.068 μF, the surface roughness is Ra=0.28 μm, when the concentration of the ER fluid is 10-10 wt % (weighted percentage concentration) and the permittivity is set as 0.068 μF, the surface roughness is Ra=0.20 μm, when the concentration of the ER fluid is 20-10 wt % (weighted percentage concentration) and the permittivity is set as 0.068 μF, the surface roughness is Ra=0.14 μm, when the concentration of the ER fluid is 0-10 wt % (weighted percentage concentration) and the permittivity is set as 0.01 μF, the surface roughness is Ra=0.10 μm, when the concentration of the ER fluid is 10-10 wt % (weighted percentage concentration) and the permittivity is set as 0.01 μF, the surface roughness is Ra=0.06 μm and when the concentration of the ER fluid is 20-10 wt % (weighted percentage concentration) and the permittivity is set as 0.01 μF, the surface roughness is Ra=0.08 μm. It is obvious that for a smaller permittivity, the surface roughness becomes better. With the increase of the concentration of the ER fluid, the optimum value of the surface roughness goes up to 0.06 μm. It is evident that both of the "EDM" process and the "surface polishing" process are successfully integrated into one process in the present invention and the surface treatment is well accomplished.

Therefore, on the basis of the above-mentioned disclosure, it is able to perform both the EDM process and the surface polishing process in one process. A novel composite machining process is thus provided in this application. It is confirmed by the experiment that the ER fluid is able to be the dielectrical liquid adopted in the EDM process so as to perform the EDM, but the essential behavior and the basic characters of the EDM process would still be reserved. Adding the ER fluid with appropriate concentration and the abrasive grits (10-10 wt %) into the EDM process so as to perform the polish for the work-piece, a machined surface with roughness of Ra=60 nm is obtained, so that the surface of the work-piece polished by the present invention bears a very fine roughness up to the order of the nanometer.

In accordance with the aforementioned disclosures, the surface treatment method proposed by the present invention bears the following advantages: (1) it possesses a rapid response rate (approximate to 1 ms) and the entire process is reversible; (2) the method is able to be combined with the EDM process; (3) it provides a flexible polishing brush able to polish surface having the complex shape and an excellent fine roughness of the machined surface is simply obtained; (4) it is pioneer method to incorporate the ER fluid into the EDM process and able to improve the polishing accuracy for the sophisticated tiny mold all over the world.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims that are to be accorded with the broadest interpretation, so as to encompass all such modifications and similar structures. According, the invention is not limited by the disclosure, but instead its scope is to be determined entirely by reference to the following claims.

What is claimed is:

1. A combined surface treatment method for combining an electrical discharging machining process and a polishing process into the same process, comprising steps of:

providing a first and a second conductors, one of which is a work-piece;

applying an electrical field between the first and the second conductors;

enclosing the first and the second conductors with a material whose viscosity is varied with an intensity of the electrical field;

actuating the first and the second conductors such that the first and the second conductors are in a relative motion with respect to each other for machining the work-piece; and alternatively switching the intensity of the electrical field between a relatively high intensity level for the polishing process and a relatively low intensity level for the electrical discharging machining process during the actuating step.

2. The method according to claim 1, further comprising a step of:

applying a voltage difference to the first and the second conductors.

3. The method according to claim 1, further comprising steps of:

increasing the voltage difference; and decreasing the voltage difference.

4. The method according to claim 1, wherein a gap exists between the first and the second conductors.

5. The method according to claim 1, wherein one type of the relative motion is to rotate one of the first and the second conductors.

6. The method according to claim 1, wherein the material includes an Electrorheological fluid and a plurality of grits.

7. The method according to claim 6, wherein the Electrorheological fluid includes a silicon oil and a starch.

8. An integrated surface treatment process for integrating an electrical discharging machining process and a polishing process into one process, comprising steps of:

providing a first and a second conductors, one of which is the work-piece;

enclosing the first and the second conductors with a material whose viscosity is varied with an intensity of an electrical field; and actuating the first and the second conductors such that the first and the second conductors are in a relative motion with respect to each other for machining the work-piece and at the same time alternatively switching the intensity of the electrical field between a relatively high intensity level for the polishing process and a relatively low intensity level for the electrical discharging machining process.

9. An integrated surface treatment device for performing an electrical discharging machining process and a polishing process within the same process, comprising:

a first and a second conductors, one of which is a work-piece, enclosed by a material whose viscosity is varied with an intensity of an electrical field;

an actuator causing the first and the second conductors to have a relative motion of the first and the second conductors with respect to each other for machining the work-piece; and a control circuit alternatively switching the intensity of the electrical field between a relatively high intensity level for the polishing process and a relatively low intensity level for the electrical discharging machining process when the actuator is operating.

10. The device according to claim 9, wherein a voltage difference is applied to the first and the second conductors so as to form an electrical field therebetween.

11. The device according to claim 9, wherein the intensity of the electrical field is varied with a variation of the voltage difference.

12. The device according to claim 9, wherein a gap exists between the first and the second conductors.

13. The device according to claim 9, wherein one of the first and the second conductors is rotated by the actuator so as to form the relative motion.

14. The method according to claim 9, wherein the material includes an Electrorheological fluid and a plurality of grits.

15. The method according to claim 14, wherein the Electrorheological fluid includes a silicon oil and a starch.

* * * * *